US008439555B2

(12) United States Patent
Brossard et al.

(10) Patent No.: US 8,439,555 B2
(45) Date of Patent: May 14, 2013

(54) TOURBILLON WITHOUT THE WEIGHT OF THE BALANCE

(75) Inventors: Florian Brossard, La Chaux-de-Fonds (CH); Hugo Lopez, Corgemont (CH)

(73) Assignee: Richemont International SA, Villars-sur-Glane (CH)

( * ) Notice: Subject to any disclaimer, the term of this patent is extended or adjusted under 35 U.S.C. 154(b) by 527 days.

(21) Appl. No.: 12/764,462

(22) Filed: Apr. 21, 2010

(65) Prior Publication Data

US 2010/0278017 A1 Nov. 4, 2010

(30) Foreign Application Priority Data

Apr. 29, 2009 (CH) ..... 0679/09

(51) Int. Cl.
*G04B 15/00* (2006.01)
*G04B 29/00* (2006.01)

(52) U.S. Cl.
USPC ..... 368/127; 368/169

(58) Field of Classification Search ..... 368/124–127, 368/168–170
See application file for complete search history.

(56) References Cited

U.S. PATENT DOCUMENTS

| | | | | |
|---|---|---|---|---|
| 5,608,694 | A * | 3/1997 | Grimm et al. | 368/127 |
| 6,402,368 | B1 * | 6/2002 | Grimm et al. | 368/127 |
| 7,188,995 | B2 | 3/2007 | Besse et al. | |
| 7,244,062 | B2 | 7/2007 | Golay | |
| 7,316,504 | B1 * | 1/2008 | Mock et al. | 368/127 |
| 7,445,375 | B2 | 11/2008 | Kasapi | |
| 2005/0243652 | A1 * | 11/2005 | Taillard et al. | 368/35 |
| 2006/0181962 | A1 * | 8/2006 | Besse et al. | 368/127 |
| 2006/0187760 | A1 * | 8/2006 | Kasapi | 368/127 |
| 2007/0041276 | A1 * | 2/2007 | Jansen et al. | 368/127 |
| 2010/0046328 | A1 | 2/2010 | Olsen | |
| 2010/0046329 | A1 * | 2/2010 | Greubel et al. | 368/132 |

FOREIGN PATENT DOCUMENTS

| | | | |
|---|---|---|---|
| CH | 691832 | A5 | 10/2001 |
| EP | 0681227 | A1 | 11/1995 |
| EP | 1617305 | A1 | 1/2006 |
| EP | 1686435 | A2 | 8/2006 |
| WO | 2004097533 | A2 | 11/2004 |
| WO | 2008125503 | A1 | 10/2008 |

OTHER PUBLICATIONS

Gafner, R., Gafner Tourbillon and Deadbeat Second, Antique Horology, Magazine of the French Association, Magazine 7, 1917-1920, 12 pgs., with English Translation.

G. Daniels, La montre: Principes et methode de fabrication, Scriptar Editions, La Conversions, Switzerland, 1993, pp. 300-302.

* cited by examiner

*Primary Examiner* — Vit W Miska
(74) *Attorney, Agent, or Firm* — Blank Rome LLP

(57) ABSTRACT

Tourbillon mechanism for a watch having a turning cage mounted in pivoting manner in a first and second cage bearing lodged in fixed elements of the watch; an escapement mobile integral with the cage; and a regulating element in the form of a spiral balance capable of oscillating around a balance staff according to pulses received from the escapement mobile. The balance staff is mounted in pivoting manner in the balance bearings lodged outside the cage. The outer extremity of the spiral hairspring is fastened to the cage through a hairspring stud.

13 Claims, 2 Drawing Sheets

TOURBILLON WITHOUT THE WEIGHT OF THE BALANCE

BACKGROUND INFORMATION

This application claims the benefit of priority to Swiss Patent Application Serial No. 00679/09, filed Apr. 29, 2009, the contents of which is hereby incorporated in its entirety by reference.

TECHNICAL FIELD

The present invention concerns a tourbillon for a watch wherein the positioning of the balance's bearings allows the weight of the balance to be subtracted from the weight of the cage in all positions of the watch.

STATE OF THE ART

The tourbillon is a device that enables the accuracy of the watch to be improved. It includes a cage mounted in rotating manner on the watch frame and a balance mounted in oscillating manner in the cage. The oscillation movement of the balance is generally maintained by an escapement, also mounted on the cage. The cage is driven in rotation by a train wheel whose last mobile engages with a pinion or wheel integral with the cage.

Despite a large number of different forms of execution of these tourbillon mechanisms, the fitting and/or arrangement of several parts in the conventional tourbillons is not yet optimal. For example, the accuracy of a tourbillon is influenced by the mass of the mobile parts and their center of gravity.

Document EP681227 discloses a tourbillon mounted on a main bearing serving to support the cage as well as the balance. Such an arrangement, however, requires a relatively large ball bearing and has a negative effect on accuracy due to the position of the center of gravity.

Document U.S. Pat. No. 7,188,995 describes a tourbillon with a base plate, a main bearing positioned in this plate, and a cage turning around a main arbor. The inside part of the main bearing is connected to the cage and a lower bearing of the balance is connected to the base plate. The cage's main arbor has an opening in which is located the balance staff. In this configuration, the lower bearing of the balance is positioned outside the cage, allowing the tourbillon's weight to be reduced and thus the tourbillon's precision to be improved. However, an upper bearing of the balance is located inside the cage and the balance's weight, depending on the positions of the watch, is thus either subtracted from or added to the weight of the cage, which has a considerable disadvantage. Furthermore, the balance pivots in the fixed lower bearing and in the upper bearing that turns with the cage, which can cause a difference of friction on each side of the balance possibly resulting in disturbances to the latter's proper functioning.

The document "La montre: Principes et méthode de fabrication", Scriptar Editions, La Conversion, Switzerland, 1993, pp. 300-302, by George Daniels, describes a tourbillon mechanism without a cage called "tourbillon Benoit". In this tourbillon mechanism, the balance pivots in a bearing fixed on a superior bearing of the escapement wheel. The balance and the bearing are coupled by a spiral. In this tourbillon mechanism, however, the balance tends to stop after a small energy decrease of the balance before the escapement wheel is inverted.

BRIEF SUMMARY

One aim of the invention is to propose a tourbillon free from the limitations of the state of the art.

Another aim of the invention is to propose a tourbillon for a watch wherein the positioning of the balance's bearings allows the weight of the balance to be subtracted from the weight of the cage in all positions of the watch.

According to the invention, these aims are achieved notably by means of a tourbillon mechanism for a watch having:

- a turning cage mounted in pivoting manner in a first and second cage bearing lodged in the fixed elements of the watch;
- an escapement mobile integral with the cage; and
- a regulating element in the form of a spiral balance capable of oscillating around a balance staff according to pulses received from the escapement mobile; characterized in that the balance staff is mounted in pivoting manner in the balance bearings lodged outside the cage.

In one embodiment of the invention, the outer extremity of the spiral hairspring is fastened to the cage through a hairspring stud.

In another embodiment of the invention, the balance bearings are lodged in the fixed elements of the watch.

In yet another embodiment of the invention, the first cage bearing is lodged in a lower plate and the second cage bearing is lodged in a fixed wheel, coaxial with the cage and integral with a main plate fastened above the lower plate.

In yet another embodiment of the invention, the lower balance bearing is mounted in the lower plate, under the lower cage bearing, and the upper balance bearing is mounted in an upper bridge, above the cage.

In yet another embodiment of the invention, the balance and the spiral hairspring are placed outside the cage, with the spiral hairspring capable of being placed above or under the balance.

In yet another embodiment of the invention, the tourbillon mechanism also comprises a balance stop or cage stop mechanism.

This solution notably has the advantage over the prior art of subtracting the weight of the balance from the weight of the cage in all positions of the watch, resulting in a better precision of the inventive tourbillon. According to certain embodiments of the invention, the configuration of the inventive tourbillon also makes it possible to choose the diameter of the balance independently of the diameter of the cage, thus affording the manufacturer greater leeway.

BRIEF DESCRIPTION OF THE FIGURES

Examples of embodiments of the invention are indicated in the description illustrated by the attached FIGS. 1 and 2, which illustrate cross section views of a tourbillon mechanism according to two embodiments of the invention.

EXAMPLE(S) OF EMBODIMENTS OF THE INVENTION

Figure 1:
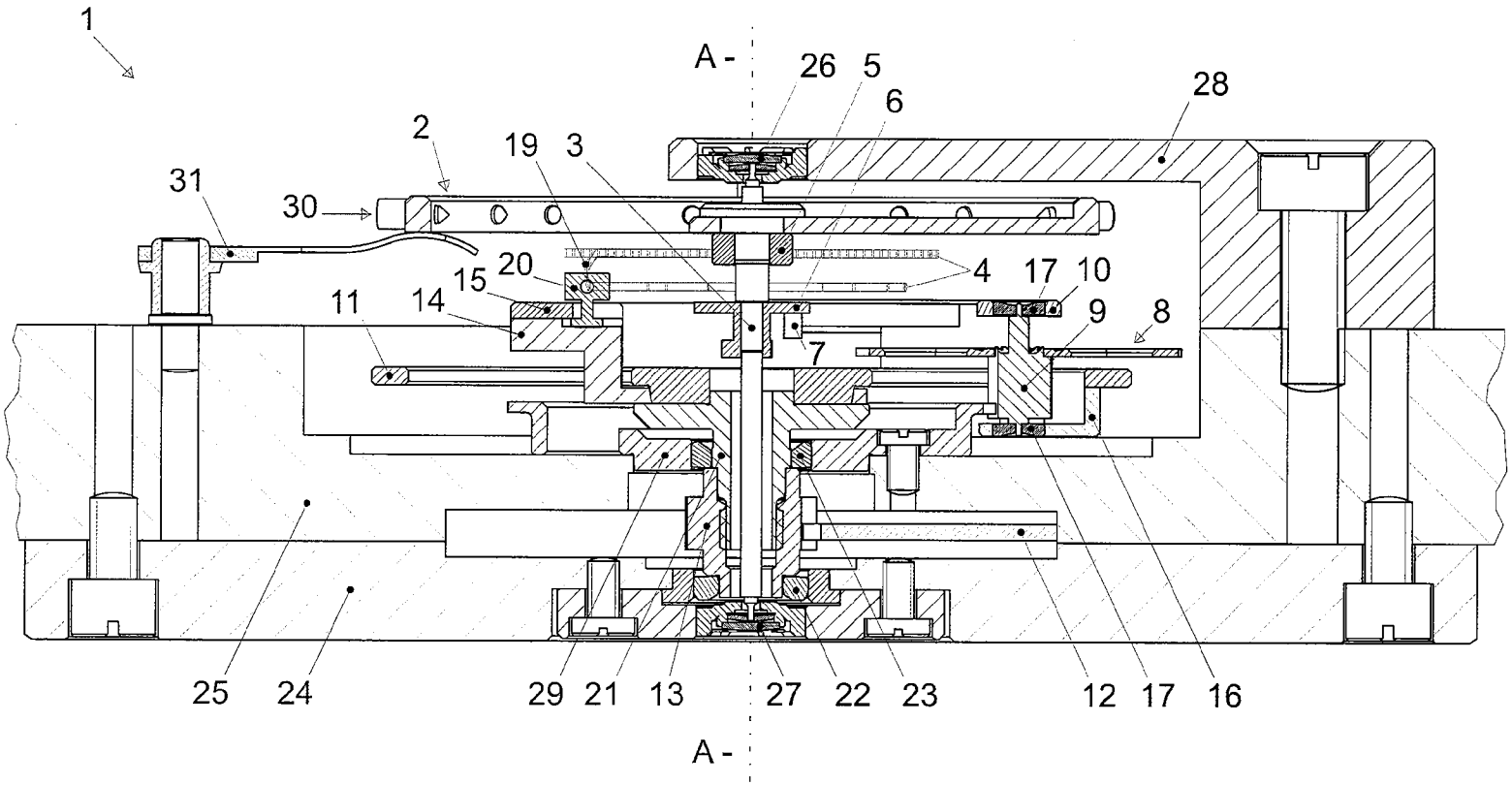

FIG. 1 represents a cross section view of a tourbillon mechanism 1 of a watch according to an embodiment of the present invention. More particularly, the tourbillon includes a cage, capable of turning around an axis A, and having a lower cage platform and an upper cage platform 10, rigidly connected to one another through pillars, not represented. The cage also includes a hollow core 21 extending under the lower platform 11, coaxial with the axis A. A cage pinion 13 is fastened on the outer periphery of the core 21.

The assembly formed by the core 21 and the cage pinion 13 is mounted in a lower bearing 22, lodged in a lower plate 24, and in an upper bearing 23, lodged in a fixed wheel 29. The latter is mounted concentrically to the cage, in a second or main plate 25 connected rigidly to the lower plate 24. The lower plate 24, the main plate 25 and the fixed wheel 29 are of course fixed elements of the watch.

An escapement mobile, having an escapement pinion 9 and an escapement wheel 8 integrally united with the pinion 9, is mounted on the cage in an integrally united manner. More particularly, the escapement mobile is mounted in pivoting manner between escapement bearings 17, such as stones, one being lodged in the upper platform 10 and the other in an escapement bridge 16 fastened to the lower platform 11.

The tourbillon mechanism 1 also comprises a regulating element in the form of a balance-spring assembly. In the example of FIG. 1, the balance 2 includes a circular felly 30 and is mounted on a pivoting balance staff 3. In this embodiment, the spiral hairspring 4 is placed under the balance 2, with the inner extremity of the spiral 4 being connected to the balance staff 3 through a collet 5. As in a conventional tourbillon mechanism, the outer extremity 19 of the spiral hairspring is fastened to a hairspring stud 20, fastened on a stud bearer 14, integral with the cage. In the example of FIG. 1, the stud 20 and the stud bearer 14 are held together by a stud bearer platform 15. The balance 2 is thus integrally united with the cage through the spiral hairspring 4 and always turns in rotation with the latter. According to an embodiment given by way of example, the cage and the balance 2 make one turn either every minute, two minutes or four minutes, with other rotation speeds being of course possible. Furthermore, in other embodiments, by introducing a differential or other system, the rotation speed of the cage could even be different from that of the balance. Contrary to the conventional configurations where the spiral hairspring is placed above the balance, the configuration in the embodiment of FIG. 1 does not require an additional bridge to be placed between the cage and the outer extremity 19 of the spiral hairspring 4.

In the example of FIG. 1, the balance 2 and the spiral hairspring 4 are also placed completely outside the cage. In this advantageous arrangement, the diameter of the balance 2 can be chosen independently of the diameter of the cage, affording the manufacturer greater leeway.

The balance 2 is connected kinetically to the escapement mobile by a pallet that transforms the wheel's rotating movement into an alternating movement. The pallet is not represented in the drawing to avoid overloading it. More particularly, the balance 2 includes a double platform 6, mounted concentrically on its staff 3 and having a pin 7 onto which the pallet fork abuts.

In the present invention, the balance staff 3 is mounted in pivoting manner through the cage but in balance bearings located outside the tourbillon cage. The balance staff 3 extends coaxially with the axis A, inside the hollow core 21 and in openings provided in the lower and upper platforms 11, 10, so as to turn freely in total isolation from the cage. The balance staff 3 is mounted in a lower balance bearing 27 lodged in fixed manner in the lower plate 24, under the lower cage bearing 22, and in an upper balance bearing 26, lodged in fixed manner in an upper bridge 28 placed above the upper platform 10 of the cage and integrally united with the main plate 25. In such a configuration, the balance staff 3 is mounted in pivoting manner in the balance bearings 27, 26 lodged outside the cage, i.e. lodged respectively above the upper platform 10 and under the second cage bearing 22, so that the weight of the balance is not supported by the tourbillon cage. Such a configuration advantageously allows the weight of the balance 2 to be subtracted from the weight of the tourbillon cage in all positions of the watch.

In a preferred embodiment of the invention, the lower and upper balance bearings 27, 26 are shock-absorbing bearings, for example of the type Incabloc®.

While the watch movement is driven, a third wheel 12 engages with the cage pinion 13, driving the turning cage in rotation around the axis A, as in the case of conventional tourbillons. The escapement pinion 9 is placed so as to engage with the fixed wheel 29 and so as to be driven when the cage turns. The escapement wheel 8, driven by the escapement pinion 9, makes the pallet oscillate, with the latter transmitting its pulses through the pin 7 to the balance 2 that oscillates.

According to the embodiment of FIG. 1, the tourbillon mechanism can also include a balance stop or cage stop mechanism, also called seconds' stop, which enables the oscillation of the balance 2 to be stopped while the watch is being reset.

In the embodiment of FIG. 1, the balance stop includes a lever 31 fastened on the main plate 25, or any other fixed element of the watch movement. Thus placed, the lever 31 is capable of pivoting around its fastening point and of pressing radially or axially on the balance felly 30 or on any other element mounted on the staff 3 so as to stop the rotation of the balance 2 through friction. The pivoting of the lever 31 can be controlled from outside the watch case, for example through a stem that can be pushed and/or pulled and which abuts on the portion of the lever opposite the one pressing on the felly 30. A sufficient pressure for quickly stopping the balance 2 when pressing the lever 31 can be achieved for example with the aid of a spring (not represented) pressing on the lever 31. The spring can be fastened on the main plate 25 or any other fixed element of the watch.

According to one embodiment, when one wishes to restart the movement after having performed a stop on the balance, the lever 31 enables the latter to restart. In fact, during its withdrawing movement, the lever 31 will for a brief moment accompany the balance in rotation to set it in motion again. In some cases, this re-launch of the balance is useful to ensure that its oscillation restarts correctly.

It will be noted that in the configuration of the tourbillon 1 according to the embodiment of FIG. 1, there is no element within the plane of the balance 2, such as cage support pillars or support elements of the spiral hairspring 4, so that the balance 2 remains easily accessible, enabling the lever to act on the felly 30 or on any other element mounted on the staff 3, without interference, independently of the angular position of the cage.

Other balance stop mechanisms are also possible.

For example, the watch can include curved mobile elements mounted on the cage and actuated through a shoe controlled by a stem accessible from outside the watch case. Such a mechanism is described notably in document EP1617305.

Figure 2:
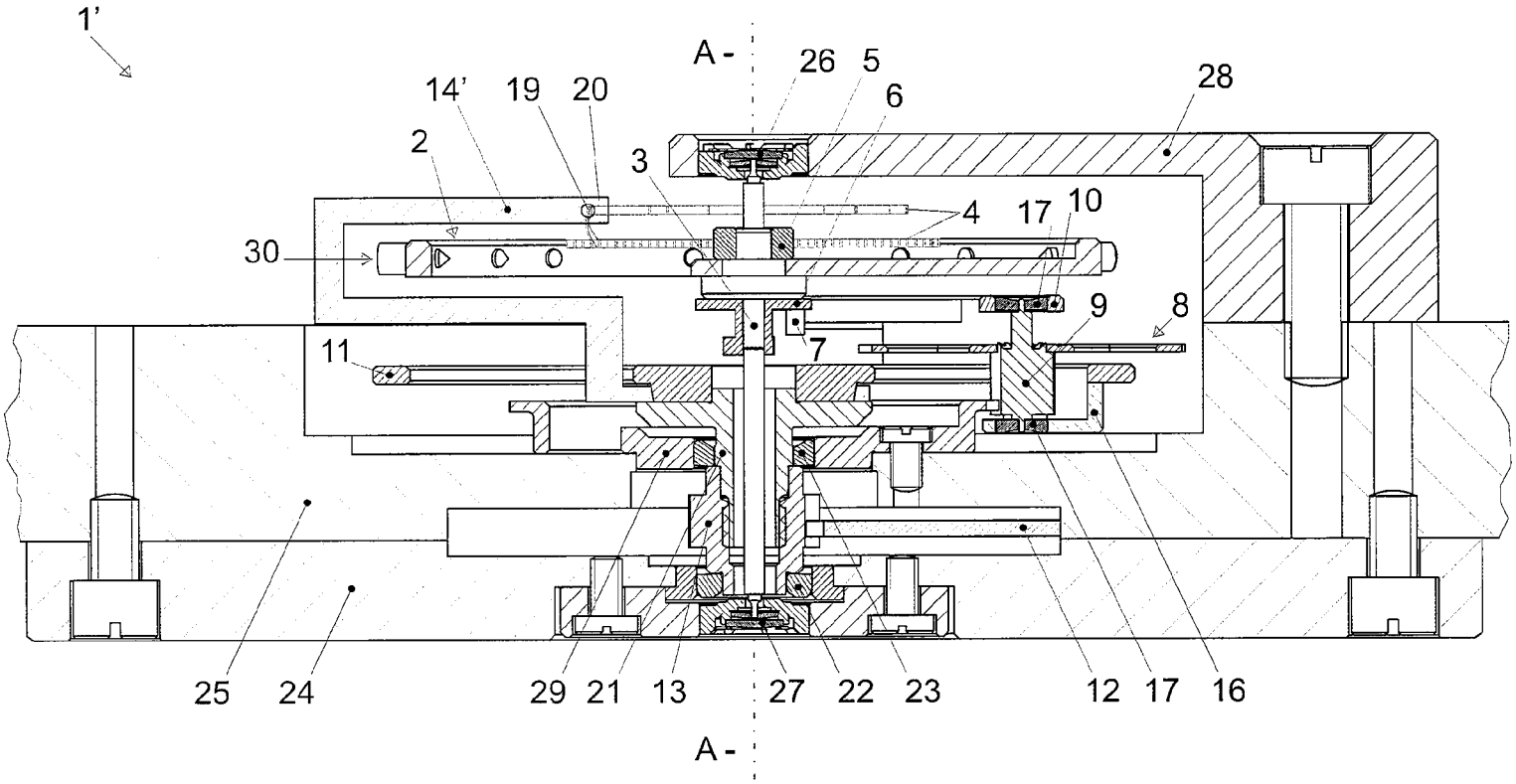

FIG. 2 represents another embodiment of a tourbillon mechanism 1' of the invention. Here, the stud bearer 14', which is fastened to the cage, circumvents the balance 2 which makes the studding of the spiral 4 easier since the latter is located above the balance and hence access to the stud is easier. Furthermore, since the stud bearer 14' shows in a very visible manner the revolutions of the cage in this embodiment, the stud bearer 14' can also serve as indicator (for example a seconds' indicator for a cage that performs one turn per minute). However, contrary to the first embodiment, in this second embodiment the diameter of the balance is limited by the stud bearer 14' and any associated balance stop mechanism (not represented in FIG. 2) must also take into account the position of this element.

Reference Numbers And Symbols Used In The Figures

1,1' tourbillon mechanism
2 balance
3 balance staff
4 spiral hairspring
5 collet
6 double platform
7 pin
8 escapement wheel
9 escapement pinion
10 upper cage platform
11 lower cage platform
12 third wheel
13 cage pinion
14,14' stud bearer
15 stud bearer platform
16 escapement bridge
17 escapement bearings
19 outer extremity of the spiral
20 hairspring stud
21 hollow core
22 lower cage bearing
23 upper cage bearing
24 lower plate
25 main plate
26 upper balance bearing
27 lower balance bearing
28 upper plate bridge
29 fixed wheel
30 balance felly
31 balance stop lever
A rotation axis of the cage

The invention claimed is:

1. Tourbillon mechanism for a watch having:

a turning cage formed by a lower platform and an upper platform mounted in pivoting manner around an axis in a first and second cage bearing lodged in the fixed elements of the watch, the lower and upper platforms together with the space between said platforms defining a volume of the cage;

an escapement mobile pivotally mounted on the cage in an integrally united manner; and a regulating element in the form of a spiral balance capable of oscillating around a balance staff according to pulses received from the escapement mobile; wherein the balance staff extends coaxially with the axis and is mounted in pivoting manner in balance bearings lodged outside the volume of the cage.

2. The tourbillon mechanism according to claim 1, wherein the outer extremity of the spiral hairspring is fastened to the cage through a hairspring stud.

3. The tourbillon mechanism according to claim 1, wherein the balance bearings are lodged in fixed elements of the watch.

4. The tourbillon mechanism according to claim 1, wherein the first cage bearing is lodged in a lower plate and the second cage bearing is lodged in a fixed wheel, coaxial with the cage and integrally united with a main plate fastened above the lower plate.

5. The tourbillon mechanism according to claim 4, wherein the lower balance bearing is mounted in the lower plate, under the lower cage bearing, and the upper balance bearing is mounted in an upper bridge, above the cage.

6. The tourbillon mechanism according to claim 1, wherein the balance and the spiral hairspring are placed outside the cage.

7. The tourbillon mechanism according to claim 1, wherein the spiral hairspring is placed above the balance.

8. The tourbillon mechanism according to claim 1, wherein the spiral hairspring is placed under the balance.

9. The tourbillon mechanism according to claim 1, further comprising a balance stop or cage stop mechanism.

10. The tourbillon mechanism according to claim 9, wherein the balance stop includes a lever mounted on a fixed element of the watch, capable of pressing radially or axially on the felly of the balance or on any other element mounted on the staff.

11. The tourbillon mechanism according to claim 10, wherein the lever allows the balance to be set in motion again when it is withdrawn.

12. The tourbillon mechanism according to claim 10, wherein the lever can act on the felly or on any other element mounted in the staff, independently of the angular position of the cage.

13. Watch comprising a tourbillon mechanism comprising a turning cage formed by a lower plate platform and an upper plate platform mounted in pivoting manner around an axis in a first and second cage bearing lodged in the fixed elements of the watch, the lower and upper platforms together with the space between said platforms defining a volume of the cage; an escapement mobile pivotally mounted on the cage in an integrally united manner; and a regulating element in the form of a spiral balance capable of oscillating around a balance staff according to pulses received from the escapement mobile; wherein the balance staff extends coaxially with the axis and is mounted in pivoting manner in balance bearings lodged outside the volume of the cage.

* * * * *